US006094493A

United States Patent [19]

Borowsky et al.

[11] Patent Number: 6,094,493

[45] Date of Patent: Jul. 25, 2000

[54] HEARING AID

[76] Inventors: Hans-Dieter Borowsky, Agnes-Miegel-Strasse 11, Neuenkirchen D-48485; Roman Jandaurek, Laustrasse 8, Rheine D-48429; Theo Wesendahl, Wieteschstrasse 49, Rheine D-48431; Edmund Löbbers, Achterkamp 15, Neuenkirchen D-48485, all of Germany

[21] Appl. No.: 09/011,506

[22] PCT Filed: Jul. 19, 1996

[86] PCT No.: PCT/DE96/01385

§ 371 Date: May 22, 1998

§ 102(e) Date: May 22, 1998

[87] PCT Pub. No.: WO97/06651

PCT Pub. Date: Feb. 20, 1997

[30] Foreign Application Priority Data

| | | | |
|---|---|---|---|
| Aug. 3, 1995 | [DE] | Germany | 195 28 482 |
| Sep. 4, 1995 | [DE] | Germany | 195 32 548 |
| Oct. 26, 1995 | [DE] | Germany | 195 39 821 |
| Dec. 1, 1995 | [DE] | Germany | 195 44 822 |
| Jan. 17, 1996 | [DE] | Germany | 196 01 535 |

[51] Int. Cl.[7] ..... H04R 25/00

[52] U.S. Cl. ..... 381/328; 381/330; 381/322

[58] Field of Search ..... 381/328, 330, 381/322, 382, 380

[56] References Cited

U.S. PATENT DOCUMENTS

| | | |
|---|---|---|
| 3,068,954 | 12/1962 | Strzalkowski . |
| 3,688,863 | 9/1972 | Johnson et al. . |
| 3,844,271 | 10/1974 | Lake . |
| 4,090,040 | 5/1978 | Berland . |
| 4,291,203 | 9/1981 | Bellafiore et al. . |
| 4,381,830 | 5/1983 | Jelonek et al. . |
| 4,539,440 | 9/1985 | Sciarra . |
| 4,612,915 | 9/1986 | Hough et al. . |
| 4,776,322 | 10/1988 | Hough et al. . |
| 5,031,219 | 7/1991 | Ward et al. . |
| 5,341,433 | 8/1994 | Meyer et al. . |
| 5,606,621 | 2/1997 | Reiter et al. . |
| 5,881,159 | 3/1999 | Aceti et al. . |

FOREIGN PATENT DOCUMENTS

| | | |
|---|---|---|
| 163 341 | 2/1960 | Germany . |
| 28 25 233 | 1/1979 | Germany . |
| 35 19 445 | 2/1986 | Germany . |
| 35 08 830 | 9/1986 | Germany . |
| 41 16 533 | 7/1992 | Germany . |

*Primary Examiner*—Curtis A. Kuntz
*Assistant Examiner*—Phylesha Dabney
*Attorney, Agent, or Firm*—Merchant & Gould P.C.

[57] ABSTRACT

The invention relates to a hearing aid with a microphone, loudspeaker, battery and other electrical or electronic components, in which there is a tube with its free end opening outwards between the temporal bone in the region of the pars petrosa and the auricle and its other end leading through an aperture in the outer ear into the acoustic duct; it receives sound at its free end and transmits the sound to the eardrum at the hearing duct end.

14 Claims, 5 Drawing Sheets

HEARING AID

The invention relates to a hearing aid according to the preamble of the main claim.

Behind-the-ear hearing aids, in particular, in which the sound is transmitted to the eardrum via the outer auditory canal are very widely used. In the case of behind-the-ear hearing aids, the sound is picked up by the microphone of the hearing aid, is amplified in accordance with audiological requirements and is passed on via the conductively coupled receiver. At the outlet of the receiver there is generally a hearing angle above the pinna for receiving a sound tube which leads into the outer auditory canal by means of an ear mold. The sound amplified by the hearing aid is thus passed via the sound tube and the sound channel above and then in front of the pinna via the ear mold directly into the auditory canal and thus to the eardrum.

However, it has been experienced as a disadvantage in these known hearing aids that the guiding of the sound, that is to say the sound tube, runs from the behind-the-ear hearing aid in front of the pinna into the outer auditory canal and is thus always visible.

So-called in-the-ear hearing aids have also already been proposed, which do not have this disadvantage, in particular when the visible surface of the in-the-ear hearing aid is adapted to the skin color of the respective patient. The disadvantage in these arrangements, however, is the fact that the auditory canal is closed, that is to say is no longer open, which is experienced as unpleasant by many patients.

The invention is based on the object of improving the known hearing aids to the effect that a hearing aid can be supplied which is invisible as far as possible, but the sound transmission is also improved at the same time and the auditory canal is not completely closed.

This object on which the invention is based is achieved by the proposal to provide a tubular body which leads to the outside behind the ear between the temporal bone in the region of the petrous bone and the pinna at one end and through an opening in the outer ear, opens out in the auditory canal at the other end, receives the sound in the region of the free end, e.g. behind the ear, and passes sound waves to the eardrum at the auditory canal end.

Advantageous refinements are explained in the subclaims.

It is thus proposed that the tubular body can be connected at its free end to the sound outlet opening of a behind-the-ear hearing aid, and it is proposed on the other hand that the tubular body itself is designed as a hearing aid and bears the microphone in the region of the free end and the receiver at the auditory canal end. In this case, it is possible for the tubular body to be extended up to the top join of the pinna and to open toward the front and to bear the microphone here. It is also possible to connect the tubular body to an earring which is then provided with the microphone.

If the tubular body is connected to a behind-the-ear hearing aid, it is important to provide a simple, but tight connection, and it is thus proposed to use a sealing cuff which is provided between the sound outlet connector of the hearing aid and a sound line and permits a connection of the wall of the sound outlet connector to the wall of the sound line, e.g. the retroauricular tubular body, which connection is virtually without stress, but is impervious to sound waves.

The tubular body may be made of a plastic material, but according to the invention is preferably produced from titanium, as a result of which it has the necessary strength and tissue compatibility. If the tubular body is produced from titanium, it is preferably of a three-part design and comprises an ear-piece, an outer piece and a connecting body, in which case it is possible for the ear-piece and the outer piece to be screwed into the connecting body so that longitudinal adjustments of the actual tubular body are thus also possible at the same time.

In particular when the tubular body consists of titanium, it appears to be advantageous to take care that a secure position of the tubular body in the body orifice is ensured, which is preferably achieved in that the outside of the tubular body is of anti-slip design. This can be achieved, on the one hand, by means of corresponding roughening or partial compacting of the outside, but it can also be achieved in the same manner by applying a kind of screw-thread to the outside, which then also provides the possibility of adjusting the tubular body in the body orifice without damaging the skin. Of course, these measures can also be provided when the tubular body is made of a plastic material.

In other words, according to the present invention, it is proposed that a hearing aid is designed, which is provided with a sound transmission opening behind the ear, preferably between the temporal bone in the region of the petrous bone and the pinna, so that the sound is guided invisibly from the rear through an opening in the outer ear, i.e. a body orifice, into the auditory canal, and the eardrum can thus be exposed to sound waves.

It is obvious that, instead of the connection of a behind-the-ear hearing aid to the tubular body, on the other hand it is also possible with today's production facilities for the tubular body itself to be designed as a hearing aid. All the required electrical or electronic components are thus installed in the tubular body which ends freely at one end behind the ear and here, for example, can bear a small microphone, and which, at the other end, ends freely in the auditory canal and here bears the receiver in the tubular body or the auditory canal. With this arrangement, it is therefore not necessary to have the cumbersome and superfluous hearing aid behind the ear, which cannot in all cases be carried securely by the ear and, on the other hand, it is nevertheless achieved that the auditory canal is not completely closed.

Exemplary embodiments of the invention are explained below with reference to the drawings, in which.

Figure 1:
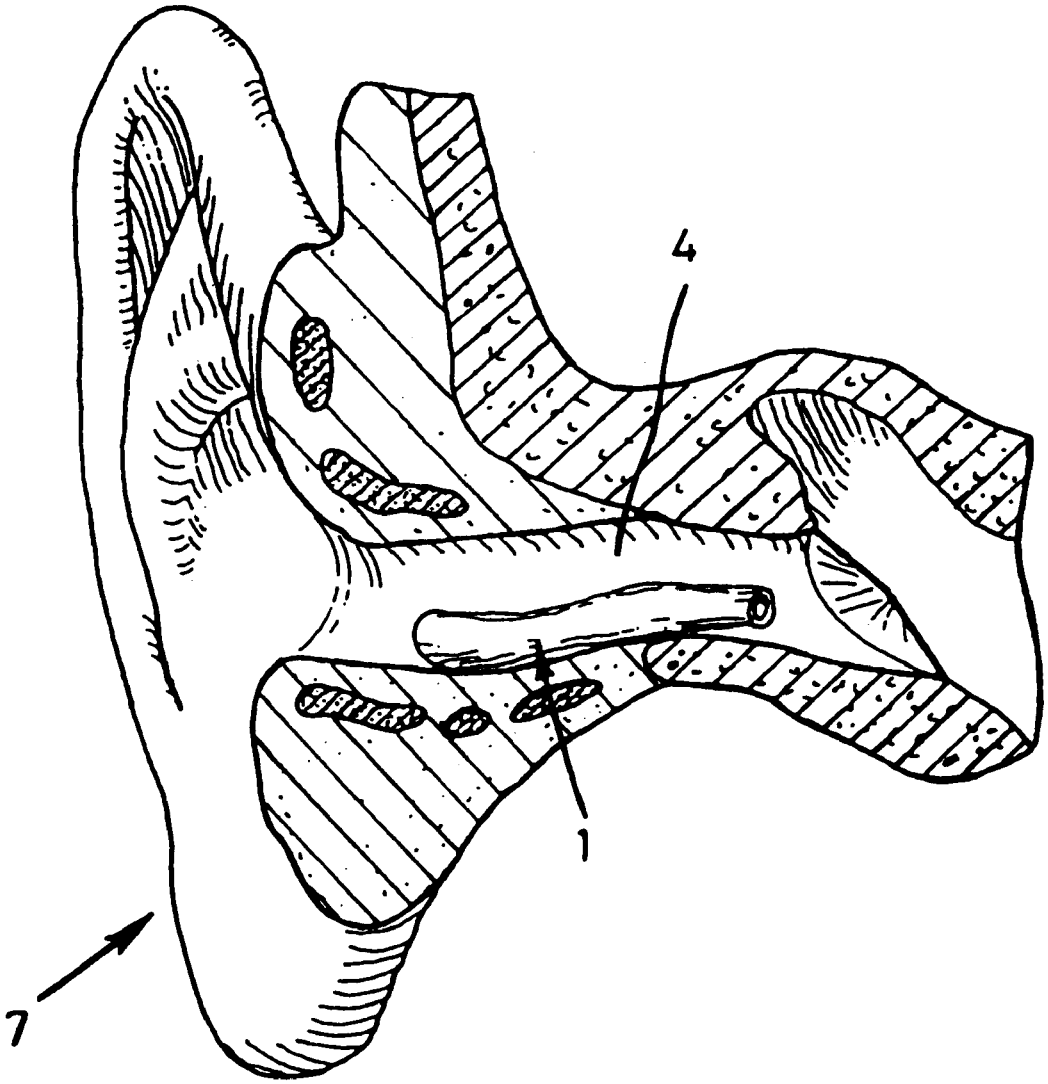
FIG. 1 shows a sectional drawing through the ear, viewed from the front, which clearly shows the tubular body located in the auditory canal.

In the drawings, 1 denotes a tubular body whose one end opens out in the auditory canal 4 and whose other end opens out between the rear of the pinna 7 and the temporal bone. In this case, this opening, designed as a sound inlet opening 2 (FIGS. 2 and 3), can be designed as a microphone 3 at the same time. A receiver 6 according to FIG. 3 is located inside the tubular body 1 at the other end which opens out freely in the auditory canal 4, and the further electrical components 5 can be seen.

In the illustration according to FIG. 1, the ear is drawn from the front, and the auditory canal 4 in which the tubular body 1 is located can be seen, which tubular body, after passing through a body orifice, now opens out freely behind the ear between the temporal bone and the pinna.

Figure 2:
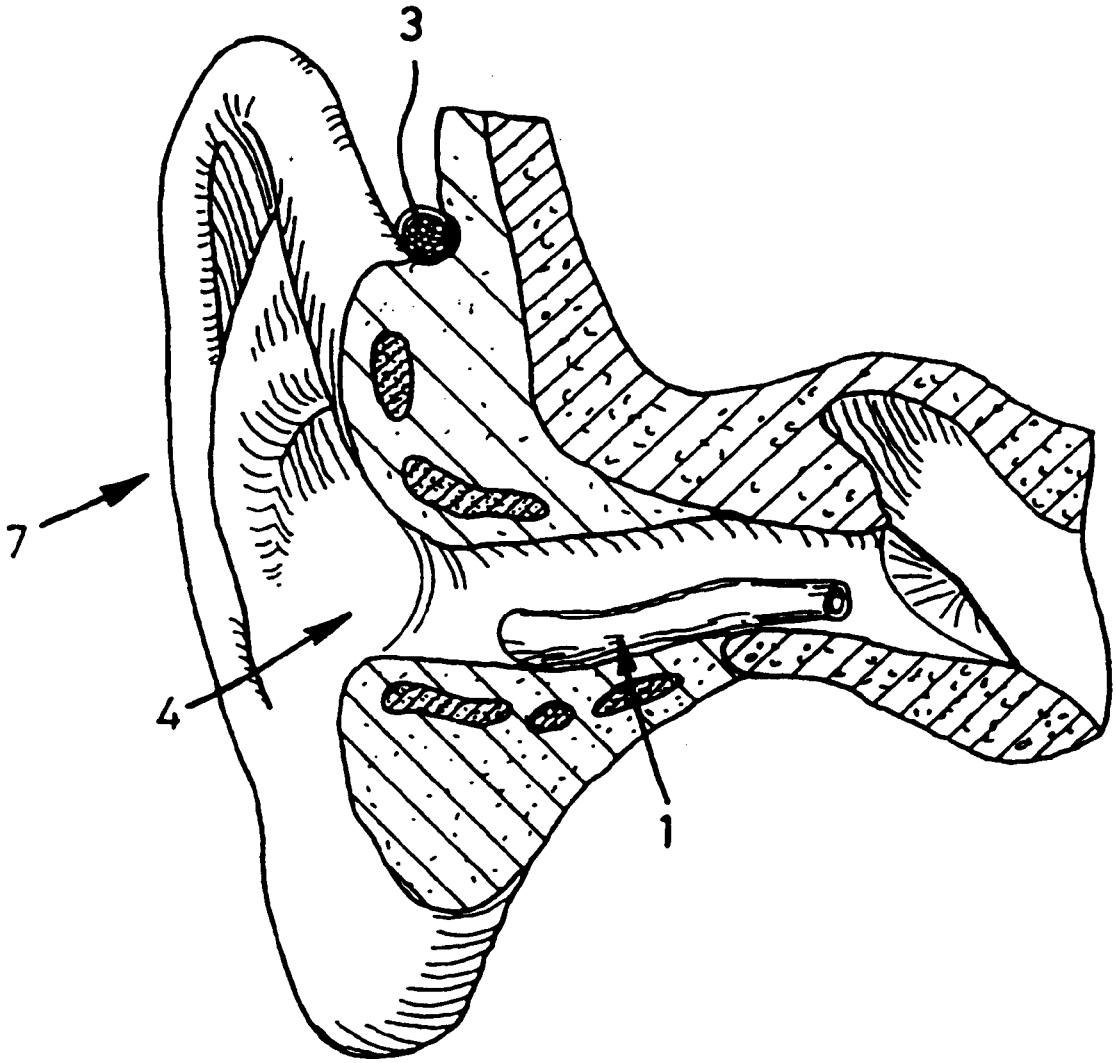
FIG. 2 shows a modified embodiment according to FIG. 1, in which the tubular body located in the auditory canal opens out to the outside at the top at the top join of the pinna.

In the embodiment according to FIG. 2, the tubular body 1 is extended upward and now opens out at the upper join of the pinna 7 and is fitted there with a microphone 3, so that the sound waves can be picked up from the front.

Figure 3:
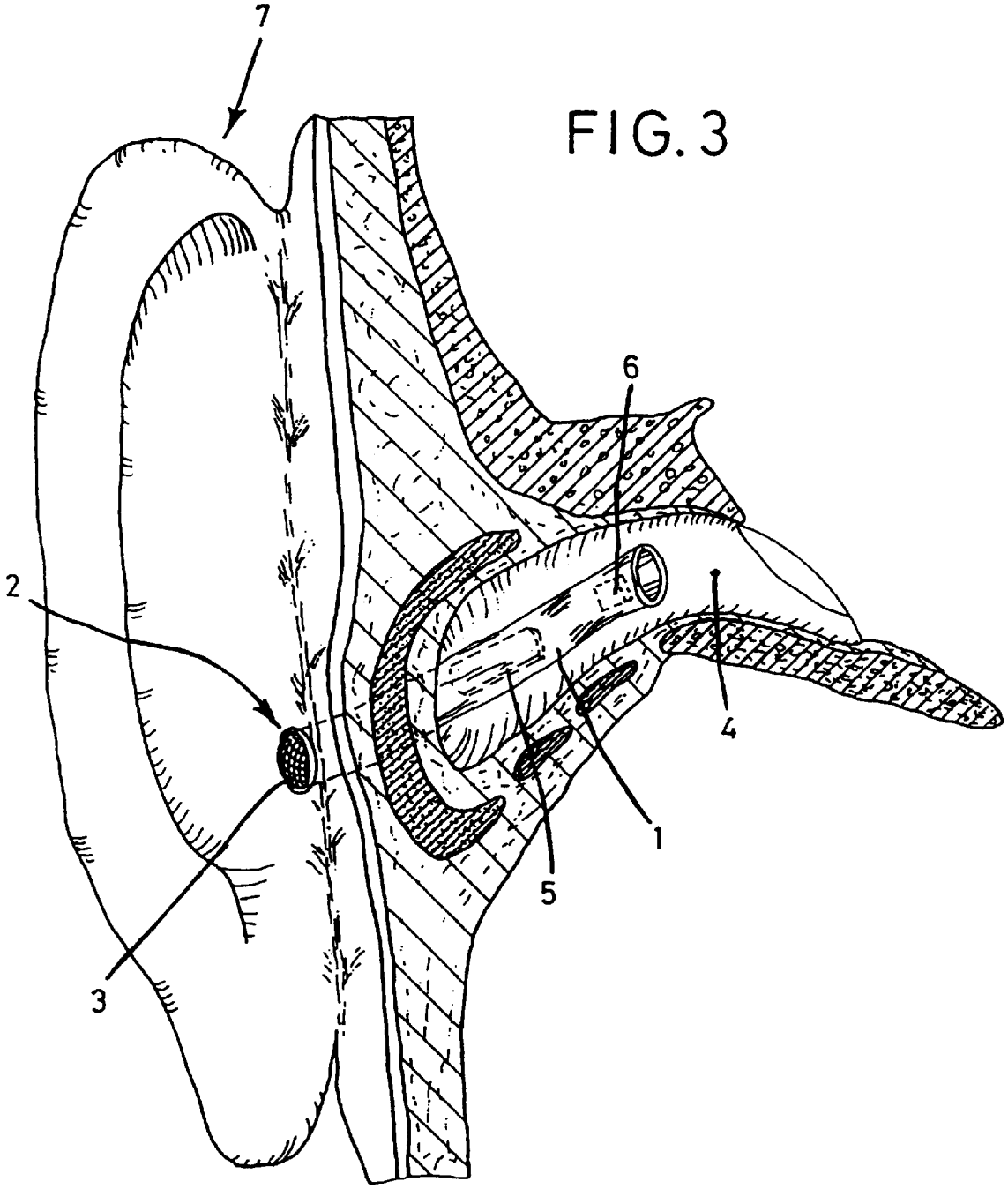
FIG. 3 shows a sectional drawing—viewed from behind the ear—which clearly shows the position of the tubular body and its opening.

In all three illustrations according to FIGS. 1 to 3, it can clearly be seen that the tubular body 1 leads from the rear through an opening in the outer ear into the auditory canal 4. This ensures in any case that it is not necessary to pass a sound tube around the pinna 7 from the outside, said sound tube also usually being visible.

Figure 4:
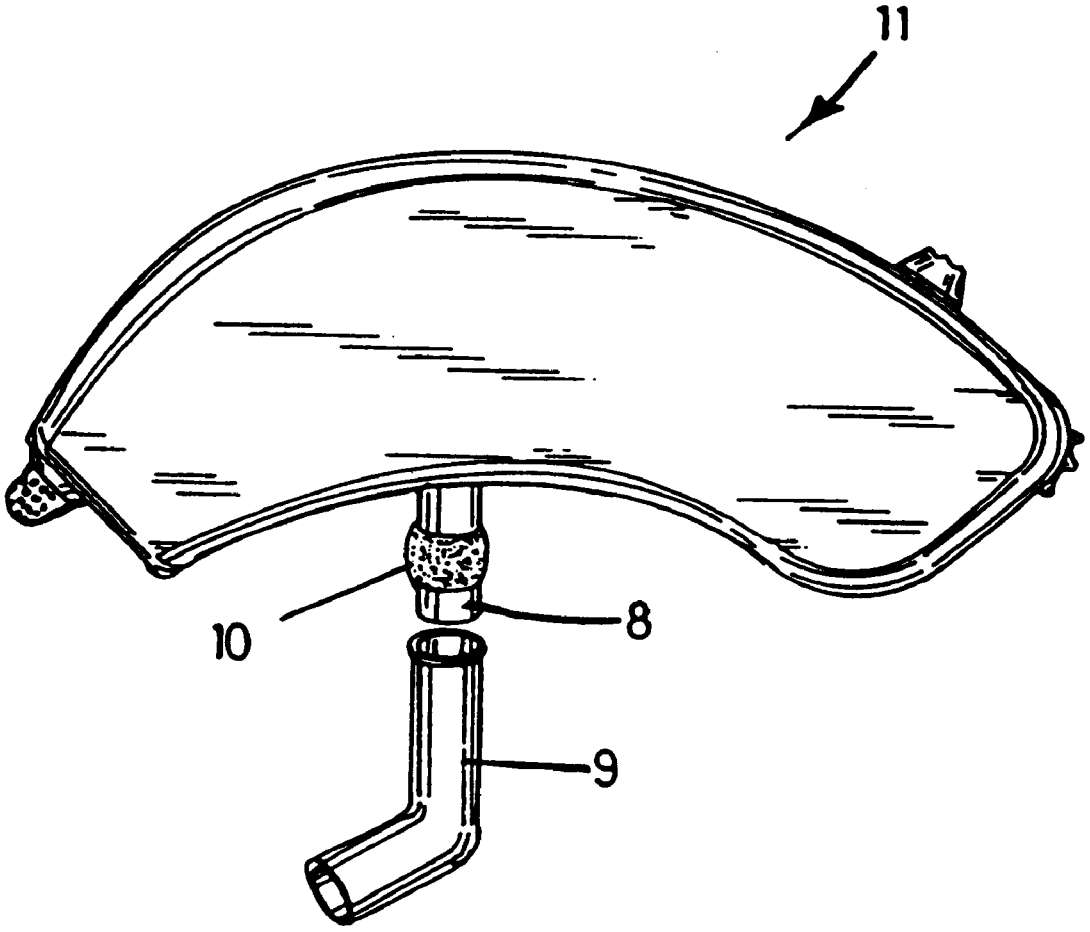
FIG. 4 shows a behind-the-ear hearing aid with a connection facility for a sound line.

The illustration in FIG. 4 shows a behind-the-ear hearing aid 11 which is fitted with a hearing angle, i.e. a sound outlet connector 8. Connected to said sound outlet connector 8 is a sound line 9 which may be designed as a separate component or may also be formed directly by the tubular body 1. The decisive factor in this illustration is the connection of the sound line 9 or the tubular body 1 to the sound outlet connector 8, said sound outlet connector 8 being provided with a sealing cuff 10 which permits a connection of the wall of the sound outlet connector 8 to the wall of the retro-auricular sound line 9, said connection being virtually without stress, but impervious to sound waves, and said sealing cuff 10 being provided on the outside of the sound outlet connector 8 and thus being located inside the sound line 9 or the tubular body 1.

The actual tubular body 1 may consist of a plastic material, but may also be produced from metal, in that case preferably of titanium which is particularly tissue-friendly.

Figure 5:
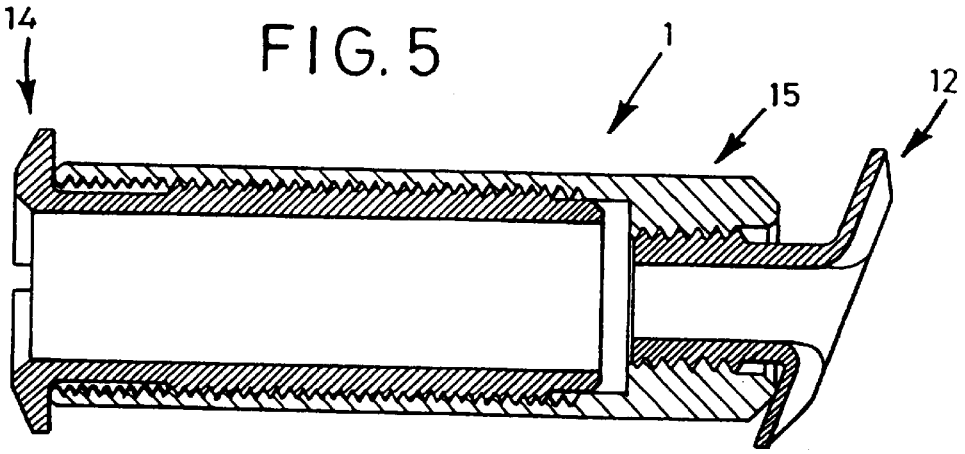
FIG. 5 shows a tubular body made of metal.
Figure 6:
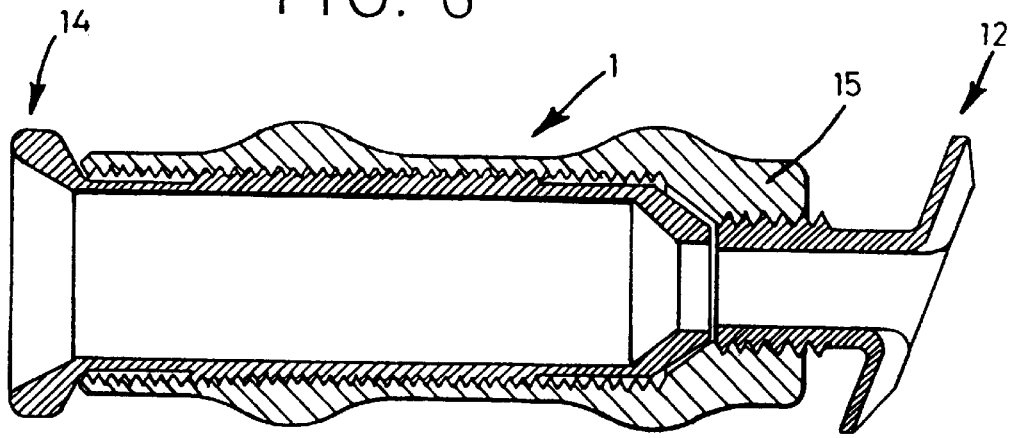
FIG. 6 shows a modified embodiment.

FIGS. 5 and 6 thus illustrate such a tubular body 1 which consists of titanium and is made up of three individual parts, namely an ear-piece 12, a connecting piece 15 and an outer piece 14 which opens out behind the ear. These three individual parts are connected to one another by a screw connection, the outer piece 14 having an external screw-thread, just as the ear-piece 12 and the actual connecting piece 15 are provided with corresponding internal screw-thread regions. This type of design has the advantage that longitudinal adaptations can be carried out both within the auditory canal and outside the ear, by now displacing the outer piece 14 lengthwise in relation to the connecting piece 15, as is the case with the ear-piece 12 which can be displaced lengthwise in relation to the connecting piece 15.

One aim is, of course, to fix the actual tubular body 1 so as to be immobile as far as possible within the body orifice and, for this purpose, it is proposed that the outside of the actual tubular body 1 is of a relatively anti-slip design in any desired form. This can be achieved, for example, by means of a screw-thread which is arranged on the outside of the tubular body 1 illustrated in FIG. 5, so that, by turning the entire component, in particular the connecting piece 15, in relation to the body orifice, adjustment as well as retention of the tubular body 1 are now possible.

The tubular body 1 according to FIG. 6 can also be provided with seals which are then located on both sides of the body orifice.

Figure 7:
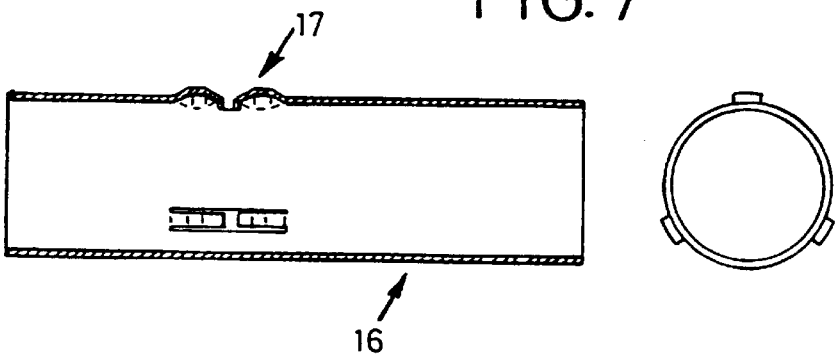
FIG. 7 shows an aid carrying tube.

Finally, FIG. 7 shows that it is possible to insert into the tubular body 1 an aid-carrying tube 16 to which all the required electrical or electronic components can be attached which form the actual hearing aid that is now arranged in the tubular body 1. The aid-carrying tube 16 is fixed resiliently by spring tabs 17 in the tubular body 1 or in the component 14 and, in this case, provision may additionally be made for an insulating tube to be arranged between the aid-carrying tube 16 and the inside of the tubular piece 14, which insulating tube now contributes to improved guiding of the sound.

What is claimed is:

1. A hearing aid with a microphone, receiver, battery and further electrical or electronic components, which has a tubular body having a free end which leads to the outside through an opening between the temporal bone in the region of the petrous bone and the pinna whereby the opening is located behind the ear, and the tubular body having an auditory canal end which opens out through the side of the auditory canal and the hearing aid receives the sound in the region of the free end and passes sound waves to the eardrum at the auditory canal end.

2. The hearing aid as claimed in claim 1, wherein the free end of the tubular body (1) can be connected behind the ear to the sound outlet opening of a behind the-ear hearing aid (11).

3. The hearing aid as claimed in claim 1, wherein the tubular body (1) bears the microphone (3) in the region of the free end and bears the receiver (6) at the auditory canal end.

4. The hearing aid as claimed in claim 3, wherein the end of the tubular body (1) bearing the microphone (3) is extended up to the top join of the pinna (7) and opens towards the front.

5. The hearing aid as claimed in claim 3, wherein the end of the tubular body (1) bearing the microphone (3) opens out into an earring.

6. The hearing aid as claimed in claim 2, wherein the sound outlet opening of the behind-the-ear hearing aid (11) is fitted with a connector (8) which can be connected to a tubular body (1) arranged in the patient's ear.

7. The hearing aid as claimed in claim 2, which has a sealing cuff which is provided between the sound outlet connector of the hearing aid and the tubular body and permits a connection of the wall of the sound outlet connector to the tubular body.

8. The hearing aid as claimed in claim 2, wherein the sealing cuff (10) is provided on the outside of the sound outlet connector (8).

9. The hearing aid as claimed in claim 1, wherein the tubular body (1) is of produced from titanium.

10. The hearing aid as claimed in claim 1, wherein the tubular body (1) is of three-part design, an ear-piece (12) and an outer piece (14) being held by a connecting body (15).

11. The hearing aid as claimed in claim 10, wherein the ear-piece (12) and the outer piece (14) are connected to the connecting piece (15) by means of a screw-thread, the ear-piece (12) and the outer piece (14) being fitted with an external screw-thread and the connecting piece (15) with an internal screw-thread.

12. The hearing aid as claimed in claim 1, wherein the tubular body (1) is of anti-slip design on its outside.

13. The hearing aid as claimed in claim 12, wherein the roughening on the outside of the tubular body (1) is achieved by a screw-thread-like design.

14. The hearing aid as claimed in claim 1, which has an aid-carrying tube (16) which can be inserted into the tubular body (1).

* * * * *